United States Patent [19]

Klass

[11] 4,426,866

[45] Jan. 24, 1984

[54] DELIVERY SYSTEM FOR BALL PEENING OR FORMING APPARATUS

[75] Inventor: Larry S. Klass, Nashville, Tenn.

[73] Assignee: Avco Corporation, Greenwich, Conn.

[21] Appl. No.: 230,728

[22] Filed: Feb. 2, 1981

[51] Int. Cl.[3] ..... B21J 1/02; B24B 39/00; B65G 25/00; B65G 17/48

[52] U.S. Cl. ..... 72/53; 29/90 A; 198/688

[58] Field of Search ..... 29/90 A; 51/319, 320, 51/434, 435; 72/53; 198/688, 698, 699, 822

[56] References Cited

U.S. PATENT DOCUMENTS

| | | | |
|---|---|---|---|
| 336,126 | 2/1886 | Ludlum | 198/688 |
| 384,458 | 6/1888 | Mathews | 198/688 |
| 937,180 | 10/1909 | Ridd | 72/53 |
| 3,000,425 | 9/1961 | Hodges et al. | 72/53 |
| 3,090,166 | 5/1963 | Straub | 51/320 |
| 3,131,457 | 5/1964 | Correl et al. | 72/53 |
| 3,498,547 | 3/1970 | Kern | 72/53 |
| 3,573,023 | 3/1971 | Thomas et al. | 72/53 |
| 3,705,511 | 12/1972 | Brandel et al. | 72/53 |

FOREIGN PATENT DOCUMENTS

| | | | |
|---|---|---|---|
| 235670 | 3/1960 | Australia | 198/310 |

*Primary Examiner*—E. R. Kazenske
*Assistant Examiner*—Paul M. Heyrana, Sr.
*Attorney, Agent, or Firm*—Ralph D. Gelling

[57] ABSTRACT

A ball peening machine used for forming or surface treatment is constructed with a unique delivery system. The peening media is loaded by gravity from a hopper to a conveyor belt which is constructed with paddles extending transverse to the direction of travel. The media is delivered to the work piece at the end of the conveyor where it turns sharply downward. The paddles tend to propel the media downward.

1 Claim, 1 Drawing Figure

DELIVERY SYSTEM FOR BALL PEENING OR FORMING APPARATUS

BACKGROUND OF THE INVENTION

Ball peening or forming is a process by which large wrought forms and shapes of metal may be surface treated or shaped by impacting a media of significant mass over the surface of the work piece. Generally the media consists of metal balls which are applied in large quantities across the width of the work piece as the work piece moves through the delivery system. The processes of the prior art utilize a variety of means for applying the media to the work piece depending on the job to be performed.

A high velocity impact may be provided by a pneumatically or hydraulically powered mechanism which forces the media under pressure through a nozzle. A system of this type is shown in U.S. Pat. No. 3,423,976. There are several limitations which are inherent in this type of construction. The media feed system is unduly restrictive and elaborate and air delivery and nozzle size restrictions severely limit the size and amount of peening media delivered. This type of ball forming system is a high air pressure system and will not deliver large size media uniformly at low air pressures or in great quantity.

Another type of delivery apparatus is shown in U.S. Pat. Nos. 3,491,563 and 3,660,943 which employ a rotating wheel or impeller to centrifuge the media against the work piece. This type of apparatus is also limited to the application of relatively small media at a high speed and the media feed system becomes more complicated with a resulting tendency to clog with large media. In addition, only a narrow width of media delivery is possible and the amount of media delivered is reduced with increasing media size.

It is generally desirable, in order to obtain the smoothest finish, to apply media of a high mass to the work piece at a slow speed. One way of accomplishing this is to construct the apparatus utilizing a gravity delivery system as shown in U.S. Pat. No. 3,705,511. This system provides the ability to use a very large size ball and its feed system is very simple. It is limited however by the height of the building as to the impact that can be achieved. It is the purpose of this invention to modify the gravity type system to eliminate the inherent restrictions while maintaining the simplicity of design.

SUMMARY OF THE INVENTION

Ball peening or forming media are dropped from a hopper onto a conveyor belt which is moving towards the point of application. The conveyor at the point of application rotates about the rollers in the downward direction. Elongated paddles or cleats are constructed across the width of the belt transverse to belt movement. The paddles extend outward from the belt a distance sufficient to engage the media as the belt turns about the rollers and propel the media towards the work piece.

DESCRIPTION OF THE DRAWING

The invention is described in more detail below with reference to the drawing which is a perspective schematic view of the ball peening or forming system of this invention.

DETAILED DESCRIPTION OF THE PREFERRED EMBODIMENT

Figure 1:
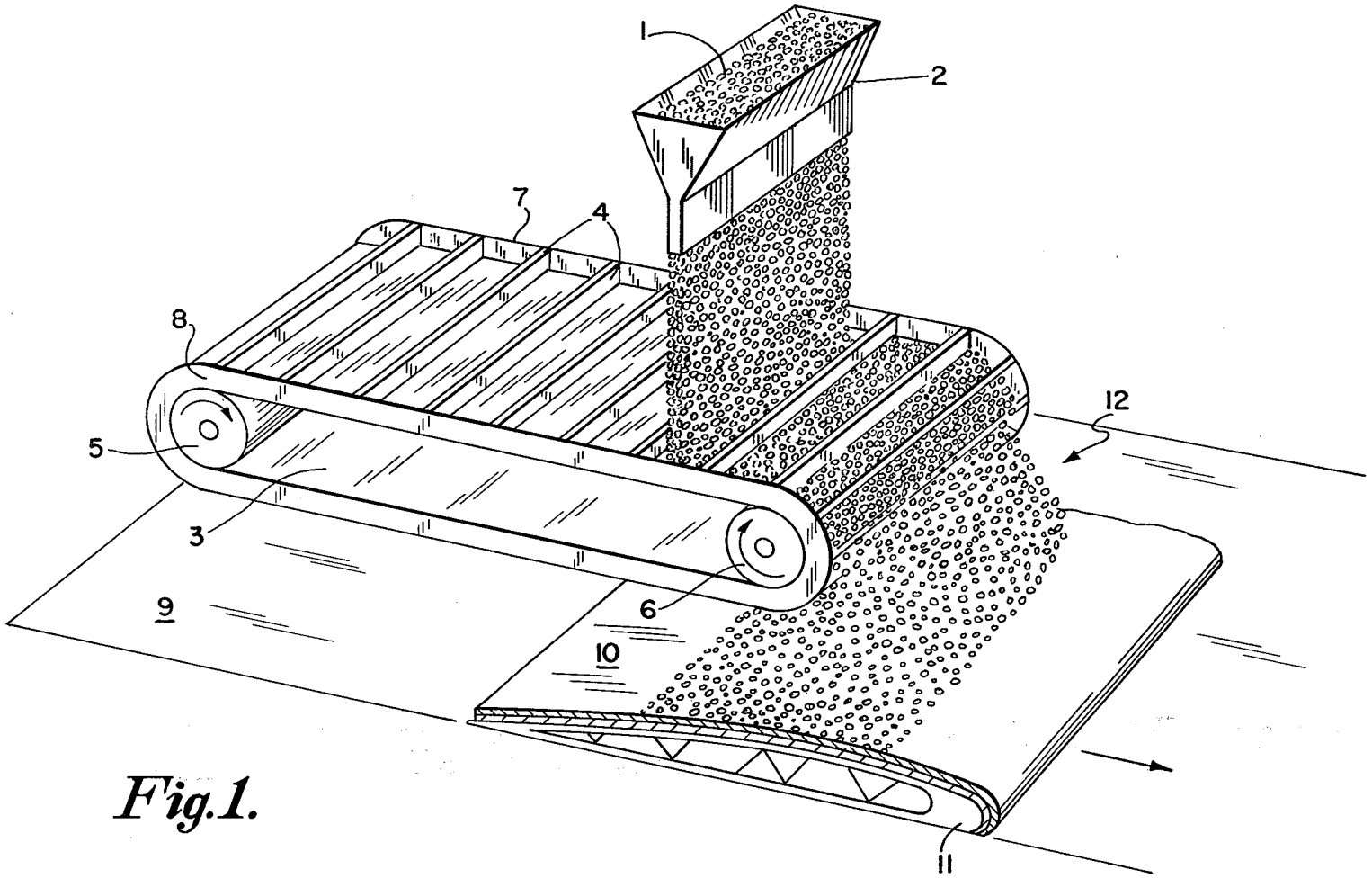

The apparatus of this invention is shown schematically in the drawing and can be adapted for either peening or ball forming operations. A media 1 consists of steel balls or the equivalent which may have a size less than or in excess of ¼ inch in diameter and even as large as 1 inch in diameter if it is desired. The media 1 is loaded into hopper 2 from which it may be dropped onto conveyor belt 3. Paddles 4 are constructed across belt 3 transverse to the direction of movement and extend outward from the plane of conveyor 3. Conveyor belt 3 moves about rollers or pulleys 5 and 6 and may be driven by any suitable means. Rollers 5 and 6 turn as indicated by the arrows and move belt 3 towards the work station 12. As belt 3 turns about roller 6, the media begins to fall towards work piece 10. The paddles 4 engage media 1 and propel it from the belt 3. In this manner an added velocity is imparted to the balls in addition to that attributable solely to gravity.

The work piece 10 may be moved into the work station on table 9 to be shaped to form 11. The delivery system shown will provide a very useful wide pattern and the slow speed and large size of the impacting media 1 will create a very desirable surface finish. The device provides a relatively flexible peening or ball forming operation without the limitations of the very low speed gravity feed or the very high speed rotating wheel or high pressure pneumatic type of apparatus. A brief comparison of this system with the wheel systems of the prior art is shown below and illustrates this greater flexibility.

| Parameters | Wheel System | Belt System |
|---|---|---|
| Size | 12" to 20" in diameter | Unlimited |
| Number of Propelling Blades | 8 | Unlimited |
| Media Feed Orifice | Very restrictive | Non-restrictive |
| Size of Media Delivered | 0.007" to 0.187" | 0.007 to 1.00" |
| Width of Delivery Blade or Paddle | 1½" to 2½" | 2" to 60" |
| Blade Material | Abrasive resistant hardened steel | Elastomeric or Low Alloy Steel |
| Operating Speed | 500–3000 rpm | 50–1000 rpm |
| Operating Velocity | High | Low |
| Media Delivery | Complicated | Simple |

For best results during operation, the rollers should be run at approximately 50 rpm to insure that a reasonable amount of force may be exerted by the paddles. The work piece can be positioned any distance below the roller 5 in the work station with a 3 to 6 foot height most practical. A collection and return system for the media is necessary as is well known in the art.

I claim:

1. Apparatus for delivering media to a work station for the purpose of working the surface of a deformable metal workpiece comprising:

a work station;

a conveyor belt mounted about rotating members above said work station for moving working media carried thereby in a first direction towards the work station, said conveyor belt constructed to turn downward about one of said rotating members at a height above the work station which is sufficient to allow a significant acceleration by gravity to said media dispensed therefrom;

means mounted forward of the work station and said downward turn of said conveyor belt for supplying said working media to the conveyor belt for movement thereon;

paddle elements mounted on the conveyor belt transverse to the first direction of movement and projecting outward therefrom to engage the media;

means operatively associated with the rotating members to drive the conveyor belt and thereby move said media in said first direction toward the work station at a speed sufficient to allow the paddles to impart an additional downward acceleration to the working media as the belt turns downward over the work station; and means to move a workpiece into the work station under the path of the working media dispensed by the conveyor belt.

* * * * *